United States Patent [19]

Berger

[11] Patent Number: 4,507,107

[45] Date of Patent: Mar. 26, 1985

[54] FILTER MANUFACTURING TECHNIQUE

[75] Inventor: Richard M. Berger, Midlothian, Va.

[73] Assignee: American Filtrona Corporation, Richmond, Va.

[21] Appl. No.: 296,122

[22] Filed: Aug. 25, 1981

Related U.S. Application Data

[62] Division of Ser. No. 96,538, Nov. 21, 1979.

[51] Int. Cl.[3] ..... B31B 23/01; B32B 3/00

[52] U.S. Cl. ..... 493/44; 493/41; 493/42; 493/45; 493/48; 493/49; 493/50; 156/62.2; 156/296

[58] Field of Search ..... 493/28, 56, 55, 54; 156/62.2, 290; 131/345, 338, 339, 340

[56] References Cited

U.S. PATENT DOCUMENTS 3,819,435 6/1974 Roberts et al. ..... 156/62.2

FOREIGN PATENT DOCUMENTS 18188 10/1980 European Pat. Off. ..... 131/341
39-28359 12/1964 Japan ..... 131/340
53-47599 4/1978 Japan ..... 131/340
918598 2/1963 United Kingdom .
933227 8/1963 United Kingdom .

*Primary Examiner*—V. Millin
*Attorney, Agent, or Firm*—Holman & Stern

[57] ABSTRACT

Method and apparatus for producing axially elongated, self-sustaining, dimensionally stable smoke rods or the like from filamentary tow by feeding the tow into a confined zone having a non-porous section and a porous section, simultaneously feeding gas under pressure into the inlet end of the confined zone at a feed rate sufficiently high so as to pneumatically convey the tow through the confined zone in a rod-like formation substantially conforming to the cross-sectional size and shape of the confined zone, and sufficiently low so as to permit escape of at least a major portion of the feeding gas from the confined zone along the porous section, introducing a heated gas into the tow in a third section of the confined zone downstream from the porous section, maintaining the tow in contact with the heated gas for a time sufficient for the gas to contact the tow across substantially its entire cross-section and render the tow bondable and cooling the heated tow to bond the same into the rod-like shape. The rod can be withdrawn at substantially the same speed as the tow is being fed or it can be withdrawn at a slower speed whereby the fibers are reoriented into an adjacent and overlapping relation to one another generally transversely to the longitudinal extent of the treating zone. The initial tow can be slit to simultaneously form a plurality of rods from a single length of the starting material.

37 Claims, 9 Drawing Figures

Fig. 1
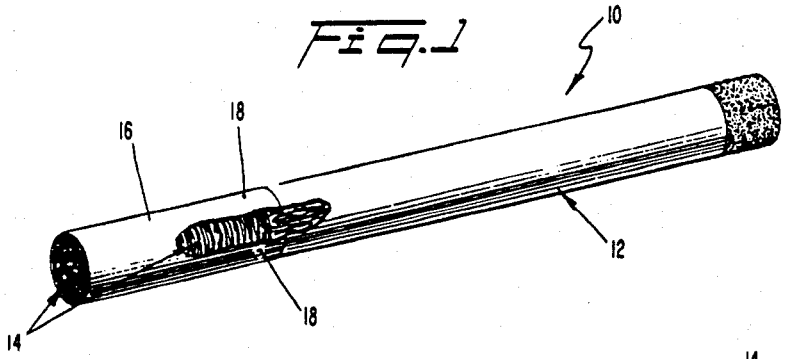
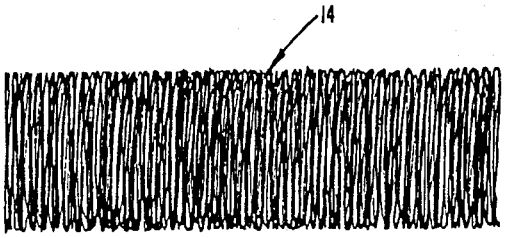
Fig. 2
Fig. 3
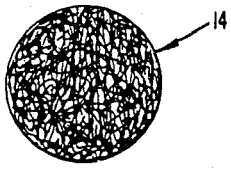
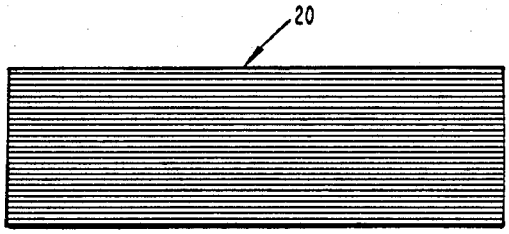
Fig. 4
PRIOR ART
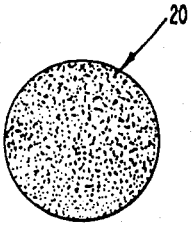
Fig. 5
PRIOR ART

FILTER MANUFACTURING TECHNIQUE

BACKGROUND OF THE INVENTION

This is a division of application Ser. No. 096,538, filed Nov. 21, 1979.

This invention relates to a production of filter means, and relates more particularly to tobacco smoke filter elements. More specifically, the instant inventive concepts are primarily concerned with producing filter means for cigarettes, although the products of this invention are generally useful as filters, particularly for tobacco smoking means, whether they be cigarettes, cigars, pipes or the like. Since filters for cigarettes are particularly commercially important, the basic embodiments of the instant invention will be discussed as they relate to the production of filtered cigarettes.

In making tobacco smoke filters for use in connection with cigarettes and the like, bondable continuous filamentary tows of substantially continuous thermoplastic fibers, such as plasticized cellulose acetate fibers, polyethylene fibers, polypropylene fibers, nylon fibers and the like, have conventionally been employed as the starting material. The term "continuous filamentary tow", as used in this specification and the appending claims, is intended to define a material such as that which results when filaments extruded from a plurality of spinnerets are brought together and combined to form a continuous body of fibers randomly oriented primarily in a longitudinal direction. In such a tow, the filaments are generally longitudinally aligned in substantially parallel orientation, but include crimped portions which may form short sections running more or less at random in non-parallel diverging and converging directions. Although the process of this invention is applicable to the various filamentary materials of this type, since plasticized cellulose acetate is the most common thermoplastic fiber used in the manufacture of cigarette filters, the specification hereof will be generally set forth in terms of this material. However, it is to be understood that the instant inventive concepts are not to be limited to this preferred embodiment.

In the manufacture of filters for cigarettes and the like, a number of different factors must be considered. Filtration efficiency, which is the capacity to remove unwanted constituents from smoke, while highly desirable is only one factor important in producing a commercially acceptable filter. Other factors, such as pressure drop, taste, hardness and cost also determine commercial acceptance of these products. For example, cellulose acetate, one of the most commonly used substances in manufacturing cigarette filters has a relatively low filtration efficiency. Increased filtration efficiency obtained by increasing the density or length of a cellulose acetate filter may cause a pressure drop across the filter which is excessively and commercially unacceptable. The use of activated carbon or other such materials having higher filtration efficiency may increase cost and deleteriously effect taste.

In recent years, air dilution has become a popular technique for compensating for the relatively low filtration efficiency of cigarette filters which have a pressure drop sufficiently low for commercial acceptance. In this technique, ventilating air is drawn into the filter peripherally and dilutes the smoke stream from the tobacco to thereby reduce the quantity of tar and other unwanted tobacco constituents drawn into the smoker's mouth with each puff.

The air dilution techniques provides several obvious advantages:

It is an extremely economical method for reducing various solid phase constituents of tobacco smoke, generally referred to as "tar".

It also enables the removal or reduction of certain gas phase constituents of tobacco smoke such as carbon monoxide and nitrous oxide.

By varying the quantity of air introduced into the filter with each puff, it permits control, within reason, of the filtration process in order that efficiency and taste can be balanced.

One of the major challenges to the cigarette filter industry has been to design a filter and filter production techniques and apparatus for producing, at high speeds, large numbers of low cost filters capable of utilizing the air dilution technique. When the air dilution technique first became commercially important, most cigarette filters were produced with an over-wrap material applied to the outside of the filament bundle comprising the filter element in order to achieve a dimensionally stable product. The manufacturing process produced an axially elongated rod comprising a core of filaments contained by a surrounding over-wrap material called the "plug wrap". After cutting the filter rods into small segments or plugs suitable for use as cigarette filters, a tipping over-wrap secured the segments to a tobacco column comprising a core of tobacco surrounded by a cigarette paper over-wrap. With the air dilution technique cigarette filters produced in the foregoing manner required a porous or permeable plug-wrap in order that the air introduced generally through selectively provided perforations in the tipping over-wrap merged with and diluted the smoke coming from the tobacco column.

Because the use of plug wrap has certain disadvantages in general discussed in some detail in U.S. Pat. Nos. 3,313,306 and 3,377,220, granted Apr. 11, 1967 and Apr. 9, 1968, respectively, the subject matter of which are incorporated herein in their entirety by reference, techniques for producing non-wrapped dimensionally stable, filter elements were developed. The significance of producing a non-wrapped, dimensionally stable, filter rod is even more pronounced for use in air diluted cigarettes in view of the high cost of porous plug wrap materials.

The techniques for producing a non-wrapped, dimensionally stable, filter rod disclosed in the aforementioned U.S. Patents and related patents commonly assigned with the instant application, are highly useful and the best way presently known for such production. The filtering material which may be continuous filamentary tow, staple fibers or particulate in form is carried through the processing apparatus by an endless porous belt through which heated gas, such as steam, and coolant gas, such as air, are passed peripherally into the filtering material to bond the same into a dimensionally stable rod needing no plug wrap at all. Thus, two advantages are gained from this very desirable method: elimination of the steps involved in applying the plug wrap and elimination of the material costs of the plug wrap itself, the latter being particularly significant when considering the high costs of porous plug wrap necessary for use in an air-diluted filtered cigarette.

Although the endless belt method for formation of non-wrapped filters has recently been the subject of wide spread commercial interest, a number of disadvantages exist with respect to its use. The woven nature of the endless belt necessary to provide its porosity to steam and air embosses the surface of the filter rod with the pattern of the belt and leaves loose fibers which render the adhesion of the tipping paper to the filter element less efficient. The forming belt itself interferes with the step of steam penetration necessary to the formation of a dimensionally stable product and reduces the efficiency of the machine because the belts wear out and have to be changed, the belt-changing process resulting in down time for the filter rod production line.

Thus, elimination of the belt for carrying the filtering material through the various processing stations would be desirable for obvious reasons. Yet, the belt was introduced, in part, as explained in the aforementioned patents, to eliminate the need to "pull" the filamentary tow, which is the most desirable commercial filtering material, through the system producing an undesirable tension on the individual filaments during processing, reducing the crimp initially present in the filaments and producing a rod with size, shape and functional characteristics which are difficult to control.

A highly desirable alternative to "pulling" the tow through the system or using a belt to "carry" the tow through the system would be to "push" the tow through the system. A pneumatic technique for making fibrous bodies has been disclosed in commonly assigned U.S. Pat. No. 3,313,665, granted Apr. 11, 1965, the subject matter of which is also incorporated herein in its entirety. In this technique, air or other feeding gas under pressure is used to "push" the tow through a confined zone where it is heated and cooled to bond the product into a rod. Moreover, this technique enables a reorientation of the individual fibers transversely of the longitudinal dimension of the rod, a feature to be discussed in more detail hereinafter. The process disclosed in U.S. Pat. No. 3,313,665 has found great commercial utility in the production of relatively large diameter "wicking" materials for felt-tip pens and the like, but has been completely unsuitable for the production of much smaller diameter cigarette filter elements because of the difficulty in dissipating the large volume of air necessary for propelling the fibrous material through the system shown in U.S. Pat. No. 3,313,665. Cigarette filter elements normally have a diameter of about 8 mm in contrast to "wicking" cartridges which are generally well over twice that size in diameter. When the confined zone is relatively large, as in the prior art process, the feeding gas may be substantially dissipated through a foraminous area of relatively short length due to the large circumference. Yet elimination of at least a major portion of the air prior to introduction of steam or the like is necessary to enable transverse penetration of the stem to the core of the tow for uniform bonding. Extension of the foraminous or porous zone, which is produced by a multiplicity of circumferential holes through the wall of the element defining the confined zone, is undesirable since such holes produce a rough inner surface which catch the tow and cause binding within the processing line. Once the to has been contacted with steam it shrinks slightly from the walls of the confined zone and is somewhat lubricated alleviating the foregoing problems. Therefore, it has been found that application of the pneumatic feeding technique to the production of small diameter rods such as cigarette filter rods can be accomplished if the amount of air can be reduced significantly from that required by prior art techniques to minimize the dissipation problem. a procedure which has not been possible heretofore, and/or if some of the air can be dissipated after steam introduction, a procedure which would result in non-uniform bonding at the core of the tow unless compensation is provided by additional residence time and significant transverse reorientation of the fibers in the presence of the steam prior to introducing cooling gas in contrast to the almost immediate cooling step of the prior art process. This enhanced residence time is particularly important in the high speed production lines necessary for commercial production of cigarette filter rods, generally well in excess of 75 meters/min and up to about 500 or more meters/min.

With respect to the high speed production requirements of commercial cigarette filter lines, it would also be highly desirable to produce a multiplicity of filter rods simultaneously from a single tow material. With prior techniques, as disclosed in the aforementioned patents, and others, such a procedure has been impossible since the resultant product was generally relatively rigid in its longitudinal dimension and could not be bent from its main direction of travel without damage, enabling only a single rod to be made in-line from a single starting tow. Producing a product having transverse flexibility would allow redirection of a plurality of rods formed from portions of a single tow for cutting the continuously formed rods into segments or predetermined length (which could be any desired multiple of a single filter element as is common in the industry). By producing a product having the individual fibers oriented in the rod generally in the adjacent and overlapping relation to one another in generally successive layers extending generally transverse to the longitudinal axis of the rod, limited transverse bending for subsequent processing would be possible and, additionally, the product would have a reduced resistance to flow of air in the transverse direction relative to its longitudinal resistance to flow, a property which is very significant in enhancing the air-dilution properties of a cigarette filter.

Transverse orientation of fibers in a cigarette filter has been shown in commonly assigned U.S. Pat. No. 3,552,400, granted Jan. 4, 1971, the subject matter of which is also incorporated herein in its entirety by reference. However, such products are produced from staple fibers, not a continuous filamentary tow requiring overwrapping and other attendant disadvantages such as difficulty in handling loose fibers and the like.

The present invention is, thus, directed to a novel fibrous body, particularly suitable for use in a cigarette filter element, as well as an apparatus and method for production of such fiberous bodies.

It is a primary object of the invention to provide porous, dimensionally stable, axially elongated fibrous bodies comprising a continuous filamentary tow of substantially continuous thermoplastic fibers bonded together throughout so as to be self-sustaining. The bonded fibers are preferably oriented within the fibrous body in an adjacent and overlapping relation to one another in generally successive layers extending generally transverse to the longitudinal axis of the fibrous body. The fibrous body has a uniform cross-sectional diameter of approximately 8 min, a relatively smooth circumferential surface for improved adhesive properties, is transversely flexible while providing commercially acceptable hardness for handling and feel, requires a relatively low quantity of material for a given pressure drop and yet has relatively high filtration efficiency for the low weight, making these bodies particularly suitable for use as cigarette filters.

While the product aspects of the instant invention are particularly significant, the method and apparatus aspects of the invention are equally important. It is therefore also a primary object of the present invention to provide techniques and equipment for producing self-sustaining, dimensionally stable, axially elongated smoke filter elements of predetermined length and cross-sectional size and shape from a bondable continuous filamentary tow of substantially continuous thermoplastic fibers in a simple, inexpensive and high-speed manner.

It is a further object of the present invention to provide a method and apparatus for producing cigarette filter elements or the like from continuous tows which requires less material and can be used to simultaneously produce a plurality of rods.

It is still another object of the present invention to provide a method and apparatus for producing such filter elements without the need for a carrying belt thereby eliminating attendant disadvantages such as the embossed product surface, down-time for belt maintenance, impedance of steam penetration and the like.

It is another object of the present invention to provide a method and apparatus which pneumatically conveys a continuous filamentary tow but is capable of producing small diameter rod products such as required for cigarette filters by utilizing less air to feed the tow and ensuring adequate steam penetration for uniform bonding throughout the rod, even at high speeds.

The foregoing and other objects of the invention are accomplished by pneumatically conveying a continuous filamentary tow by means of a jet which feeds the conveying gas, preferably air, at a specified angle into a confined chamber. The air is preferably fed annularly around the tow at the entrance end of the confined chamber to produce a venturi effect which draw the continuous filamentary tow into the chamber. The use of a particularly small acute angle of air feed through the jet into the confined chamber, preferably between 0 and 20°, requires a much smaller volume of conveying gas to convey a given amount of filamentary tow than with previously available equipment. Because a much reduced colume of conveying gas is used, at least a major portion, and preferably substantially all, of the conveying gas may be conveniently dissipated through a limited porous section of the confined chamber without requiring a cross-section of the chamber so large that the fibrous body formed in the confined chamber cannot be commercially used for a sigarette filter. The pneumatic feed in combination with a reduced take-off speed, and in preferred embodiments a slightly reduced cross-section at the cooling zone bends the fibers of the tow perpendicular to the longitudinal axis of the confined chamber. The arrangement of the fibers in the filter thus formed is substantially overlapping and generally transverse to the longitudinal axis of the filter rod being formed. The fibers are cured with steam or other heated gas in this transverse overlapping relationship and the layers of fiber are even further compacted in a preferred embodiment utilizing an extended steam soaking chamber and reduced cross-section cooling zone, prior to the rod being extruded from the apparatus. Because the formed body is extruded, the filamentary material is in a relaxed state and maintains its crimped shape. Additionally, secondary crimp is imparted to the fibers by extruding the filter rod at a linear rate of feed less than that of the incoming tow. Furthermore, the material is forced against the wall of the confined chamber, particularly when the cooling zone is of reduced cross-section and thus a precision size and shape of the filter can easily be maintained.

Because the product formed by this method is manufactured from continuous fibers there are substantially no loose ends or fibers exposed on the surface of the filter rod so formed. Significantly, because the process and apparatus disclosed in the present invention, makes much more efficient use of the filamentary tow in producing the filter rod, the continuous filamentary tow may be divided into several portions, and each portion fed to a separate rod-forming station. Additionally, because the filter rod produced by the instantly disclosed process may be bent without breakage, subsequent processing of the filter rod into filter elements may be accomplished at numerous stations arrayed perpendicularly to the outlet end of the rod-forming station. It should, however, be borne in mind, that processing of the filter rods may also be accomplished at stations generally in line with the rod-forming station.

Another effect of the transverse orientation of the fibers in the filter rod is that the air resistance to flow is opposite that of conventional non-wrapped cigarette filters. Conventional filter elements have lower resistance to flow longitudinally and higher resistance to flor transversely. The filters produced by the instant process, however, have higher resistance to flow across their length. The higher longitudinal resistance permits a weight saving of up to 40% of the weight of conventionally produced filters having the same resistance of pressure drop. In addition, the lower resistance to flow across the width of the filter permits increased efficiency in air dilution such that fewer perforations in the tipping paper are required for filters produced by the instant process to achieve the same amount of dilution as conventionally produced air filution filters. A further advantage of the low resistance to flow across the width of the filter is that dilution of the smoke is much more uniform than with conventional filters, which, it is believed, leads to reduction of certain gas phase constituents of the smoke, such as carbon monoxide.

The particular feed jet used in the instant invention, offers considerable savings in the amount of conveying gas required for manufacture of the filters. A savings of from 50–85% compared to jet use in prior pneumatic processes has been achieved. Significantly, because the process of the instant invention uses pneumatic means, machine efficiency is increased by elimination of the belt and belt drive apparatus and concomitant maintenance to both required for other non-wrapped filter production techniques.

A further advantage of the instant invention is its versatility. Using only one tow item, it is possible to produce filters having a range of pressure drops simply by varying the input to the feeding jet and maintaining a constant take-off of the fibrous body produced by the jet, or vice-versa.

Perhaps the most unexpected advantage of the instant inventive concepts is the production of filter elements using less material per unit volume, i.e., lower weight, while resulting in improved filtration efficiency, whereas all other prior weight-saving techniques resulted in no improvement or significant loss in filtration efficiency.

Bearing in mind the foregoing discussion, the invention will be better understood by reference to the following detailed illustration which makes reference to the accompanying drawings wherein:

FIG. 1 is a perspective view, partially broken away for illustrative clarity, through a filtered cigarette incorporating a filter element according to the instant invention.

FIGS. 2 and 3 are schematic longitudinal cross-sectional and end views, respectively, of a filter rod produced according to this invention and FIGS. 4 and 5 are similar views of a conventional filter rod.

Like reference characters refer to like parts throughout the several views of the drawings.

Figure 6:
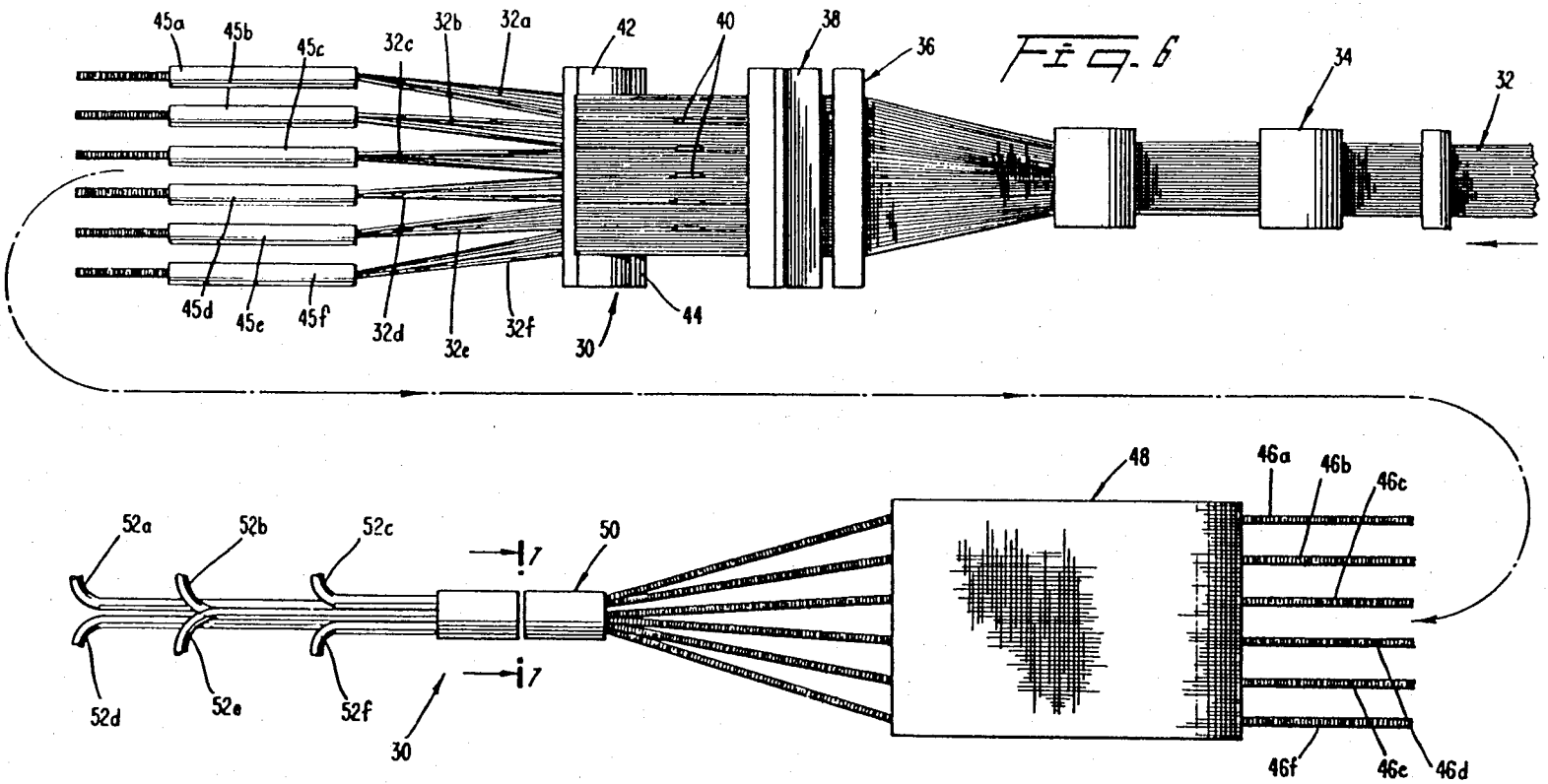
FIG. 6 is a schematic plan view of a preferred processing line for the manufacture of filter rods according to this invention.

Referring now to the drawings in general, and more particularly to FIG. 1, a filtered cigarette according to the present invention is designated generally by the reference numeral 10 and comprises basically a tobacco rod 12 and a filter plug 14 secured together in a conventional manner by tipping overwrap 16. For air-diluted filtered cigarettes, the tipping overwrap 16 has a multiplicity of circumferentially spaced perforations 18 which serve to admit ambient air peripherally for mixture with the tobacco smoke in a well known manner.

The filter plug of the instant invention is schematically shown enlarged in FIGS. 2 and 3 and comprises a porous, dimensionally stable, axially elongated rod formed of a continuous filamentary tow of substantially continuous thermoplastic fibers bonded together throughout to be self-sustaining, the fibers being oriented within the filter plug 14 in an adjacent and overlapping relation to one another in generally successive layers extending generally transverse to the longitudinal axis of the filter element. It is to be understood that the overlapping layers shown schematically in FIGS. 2 and 3 results from the preferred processing techniques of the instant invention to be discussed in more detail hereinafter, although in selected embodiments, and for particular application, the continuous body of fibers may be randomly oriented primarily in a longitudinal direction as shown in the prior art illustrations of FIGS. 4 and 5 at 20. It is also emphasized that these figures are schematic representations and that the individual filaments, in actual practice, include crimped portions which may form short sections running more or less at random in non-parallel, diverging and converging directions, the points of contact of the filaments being bonded together to form the porous or permeable element providing a labyrinth of smoke passages along the length of the filter.

The preferred arrangement of FIGS. 2 and 3 wherein the fibers are oriented within the filter element in an adjacent and overlapping relation to one another is generally successive layers extending generally transverse to the longitudinal axis of the filter element provides the resultant product with a number of unique properties. Depending upon the density of the layers produced according to the techniques of this invention, the filter element may well have a resistance to flow which is higher in the longitudinal direction than in the transverse direction, in contrast to conventional prior art filter elements, thereby enabling a relatively high ratio of ventilation air to smoke in the mixture. With such an arrangement, relatively high pressure drop in the filter element itself may be utilized because of the high dilution possible. Additionally, although the resulting rod to be described in more detail hereinafter which is, effectively, a multiplicity of filter elements integrally connected in end-to-end relationship to each other, is relatively weak when subjected to tension at its ends, forces of this nature are seldom encountered in processing and use of such products. However, the filter rod or individual element has adequate "hardness", that is, transverse strength such as would be encountered in conventional cigarette manufacturing equipment or from the lips of the smoker in use. Moreover, the elongated rod may be bent during processing to facilitate the simultaneous production of a multiplicity of filter rods from a single tow in a manner to be described in more detail hereinafter. Additionally, the surface of the filter element is formed by bent portions of individual fibers of the continuous filamentary tow inherently avoiding fraying problems as have been experienced in certain prior art products.

Reference is now made particularly to FIGS. 6–9 for schematic illustrations of a preferred method and apparatus for producing filter rods and elements according to the present inventive concepts. The overall processing line is designated generally by the reference 30 in FIGS. 6 and 8 and, at the start, utilizes conventional techniques and devices for a number of the steps. The tow 32 is passes from a conventional bale (not shown) through the usual tow preparation station 34 and into a conventional banding jet shown schematically at 36 and a plasticizer applying means shown schematically at 38. Utilizing cellulose acetate tow, a conventional plasticizer such as triacetin is sprayed on the banded tow in the plasticizer cabinet 38 in a well known manner. Although the instant inventive concepts may be used for the production of a single rod from the continuous filamentary tow, the drawings illustrate the preferred embodiment of producing a multiciplicity if filter rods from a single tow by slitting the tow 32 as shown at 40 into a plurality of tow sections 32*a*, 32*b*, 32*c*, 32*d*, 32*e* and 32*f* for further processing. It will be understood that although the tow has been shown as being slit into six sections, more or less tow sections could be utilized without departing from the instant inventive concepts.

The individual tow sections are delivered by rolls 42,44 into rod-forming stations designated generally by the reference numerals 45*a*–45*f*, the details of one of which will be explained in discussing FIG. 9 hereafter.

Figure 7:
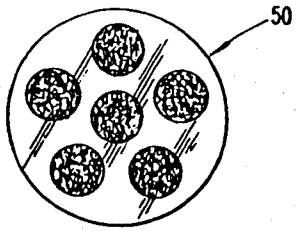
FIG. 7 is a transverse cross-section taken substantially on line 7—7 of FIG. 6.

The resultant rods 46*a*–46*f* are fed by a pulling device designated generally by the reference numeral 48 and shown schematically as a pair of endless belts 48*a*, 48*b* into a common cutting means designated generally by the reference numeral 50 wherein the filter rods are arrayed in a cluster-like arrangement shown particularly in FIG. 7 in which they are maintained in separately confined spaced relation to one another and subjected to a common cutting step. At this point, the rods 32*a*–32*f* may be simultaneously transversely cut into a multiplicity of segments of substantially equal predetermined length, which may be equivalent to a single filter plug, a double filter plug or individual rods of any multiple filter plug length, such as are conventionally utilized in cigarette making machinery.

Following the cutting step each group of segments is pneumatically conveyed through a separate tubular conduit 52*a*–52*f* to a recovery or packing station (not shown). The air tubes 52*a*–52*f* utilize conventional pneumatic techniques to feed the segments or elements through the conduits and need not be explained in further detail.

Figure 9:
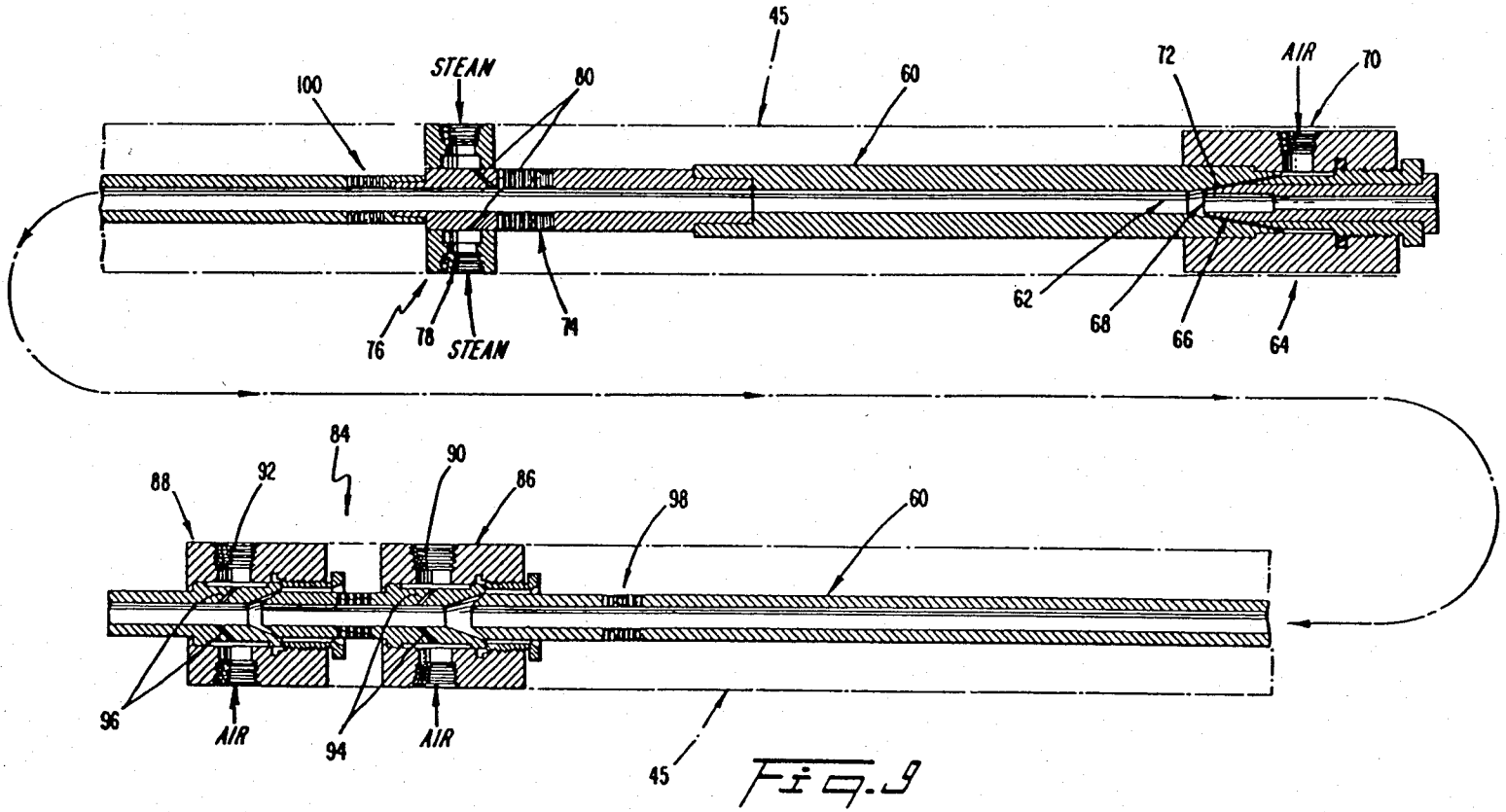
FIG. 9 is an enlarged schematic cross-section of a preferred embodiment of the rod-forming station.

Reference is now made particularly to FIG. 9 for a detailed description of a preferred rod-forming means or station designated by the general reference numeral 45. It will be understood that the showing in FIG. 9 will be equally applicable to any of the rod-forming means 45*a*–45*f*.

The rod-forming means 45 comprises basically an elongated hollow member 60 defining an elongated confined zone therewithin having throughout its length substantially uniform cross-sectional size and shape at least up to the point where coolant gas is introduced as will be explained in more detail hereinafter.

The interior walls of the confined zone may be coated with polytetrafluoroethylene (Teflon) or other such material, if desired, to provide reduced friction therein.

The tow 32 is fed into the inlet end 62 of the hollow member 60 pneumatically by a unique tow feeding means designated generally by the reference 64. The tow feeding means or jet 64 comprises an elongated tubular member 66 having a bore whose cross-sectional size and shape is slightly smaller than that of the confined zone within the hollow member 60, the outlet end 68 of which leads into the inlet end 62 of the hollow member 60. A feeding gas, which may conveniently be air under pressure is introduced into the tow feeding means 64 through the conduit 70 which communicates with an annular passageway 72 disposed concentrically around the tubular member 66 and terminates at its outlet end in a venturi throat leading into the inlet end 62 of the confined zone within the hollow member 60. The feeding gas passes into the inlet end 62 of the confined zone within the hollow member 60 in the same general direction as the tow 32 at an angle of about 0°–20°, preferably about 10°, with respect to the longitudinal axis of the confined zone and at a feed ratio sufficiently high so as to pneumatically convey the tow through the confined zone in a rod-like formation substantially conforming to the cross-sectional size and shape of the confined zone and sufficiently low so as to permit escape of at least a major portion of the gas from the confined zone along a porous portion 74 of the hollow member spaced downstream of the tow-feeding means 64.

The porous portion 74 of the hollow member 60 is capable of eliminating a major portion, and preferably substantially all, of the feeding gas because of the relatively low volume of feeding gas required utilizing the unique and preferred jet 64 of the instant invention. It is important to eliminate substantially all of the feeding gas at this point in the rod-forming means in order to enable the further processing steps to produce a uniformly bonded continuous rod. Utilizing prior art devices and techniques it has been impossible to efficiently dissipate the relatively large quantities of feeding gas required in the production of a small diameter rod such as is required for use as a cigarette filter, nominally on the order of about 8 mm. Since the hollow member required for the production of such a small diameter rod has a likewise small circumference as compared with the production of a relatively larger diameter product of the type shown in aforementioned U.S. Pat. No. 3,313,665, significantly fewer gas dissipation holes are available in a given length of the hollow member. Extending the porous section longitudinally is particularly disadvantageous at this point in the processing in that the holes or perforations provide a roughened interior surface in the hollow member tending to snag or bind the filamentary tow resulting in a stopping of the processing line. With the unique jet 64 of the instant invention feeding gas at a very shallow angle around the incoming tow, substantially smaller quantities of gas are necessary to pneumatically convey the tow through the confined zone enabling dissipation with a relatively short porous portion.

The jet 64 creates, at the inlet end 62 of the confined zone within the hollow member 60 a suction effect which serves to draw the incoming tow 32 into the confined zone at a rate proportional to the gas feed rate. Preferably, the rod-like formation of incoming tow being fed into the inlet end of the confined zone is of sufficient density so as to substantially prevent escape of the feeding gas backwardly through the incoming tow.

After passing the porous portion 74 where at least the major portion of the feeding gas is dissipated, the tow is pushed into and through a heating station 76 which comprises a means for introducing a heated gas, preferably steam, into the tow, the heat rendering the tow bondable in a well known manner. Preferably, steam under pressure is introduced through conduits such as shown at 78 into a multiplicity of peripheral passageways 80 to enter the tow countercurrently with respect to the direction of travel of the tow through the confined zone within the hollow member 60. At least the major portion of the stem will condense on contact with the tow delivering the heat necessary to render the tow bondable at the points of contact of the individual filaments in a well known manner.

It is extremely important, particularly at the high speed production rate utilized commercially, to maintain the tow in contact with the steam for a time sufficient to permit uniform contact across substantially the entire cross-section of the tow within the confined zone of the hollow member 60. To this end, a tow-soaking station 82 is provided in the form of an elongated portion of the hollow member 60 downstream of the steam ring or station 76. The tow-soaking station 82 provides extended residence time in contact with the steam so as to enable the steam to penetrate into the very core of the tow within the confined zone prior to setting of the rod. A residence time of at least about 0.1 seconds and preferably 0.2–0.5 seconds has been found desirable. In prior art techniques, such as shown in the aforementioned U.S. Pat. No. 3,313,665, the tow was set substantially immediately after contact with the steam which, while adequate for relatively slow rates of production, does not enable complete penetration of the steam to the center of the tow within the confined zone at speeds well in excess of 75 meters/min. and up to 500 or more meters/min. as is possible with the instant inventive concepts.

After adequate soaking of the tow by the steam, the tow is pushed into and through a means designated generally by the reference 84 for introducing a coolant gas, such as air, into the heated tow to bond the same into a self-sustaining, dimensionally stable, filter rod having the ultimate predetermined cross-sectional size and shape. In the embodiment shown, the cooling station 84 is separated into primary and secondary cooling means 86, 88, each of which has conduits, 90, 92, respectively, communicating with a multiplicity of peripheral apertures 94, 96, respectively, arranged to feed the coolant gas co-currently with respect to the direction of travel of the tow.

Notwithstanding the co-current direction of flow of the coolant gas, it has been found that a back-pressure can be produced by the coolant gas in the confined zone of the hollow member 60 which can slow down or bind the processing steps. To alleviate this problem, one or more additional porous portions 98, 100, can be provided in the hollow member 60, preferably immediately before the first cooling station 86 and immediately after the heating station 76 as shown in FIG. 9. The provision of porous portions at this point in the processing line causes less of a problem than the porous portion 74 prior to the introduction of the steam since the steam acts as a lubricant to the tow and, additionally, causes the tow to shrink slightly from the inside walls of the confined zone thereby avoiding snagging of the tow by the roughened interior of the porous portions.

Preferably, the confined zone defined by the interior of the cooling sections 86,88 is equal to the cross-sectional size and shape of the ultimate product and slightly smaller in cross-sectional size than the cross-sectional size of the confined zone within the hollow member 60 prior to the cooling station. This arrangement enables a final sizing of the product at the cooling station as the tow is set and produces a secondary packing of the filaments of the tow in the tow-soaking means 82 due to the slight resistance encountered at the cooling station and the relatively limp nature of the tow after it has been heated in the steam ring 76.

Figure 8:
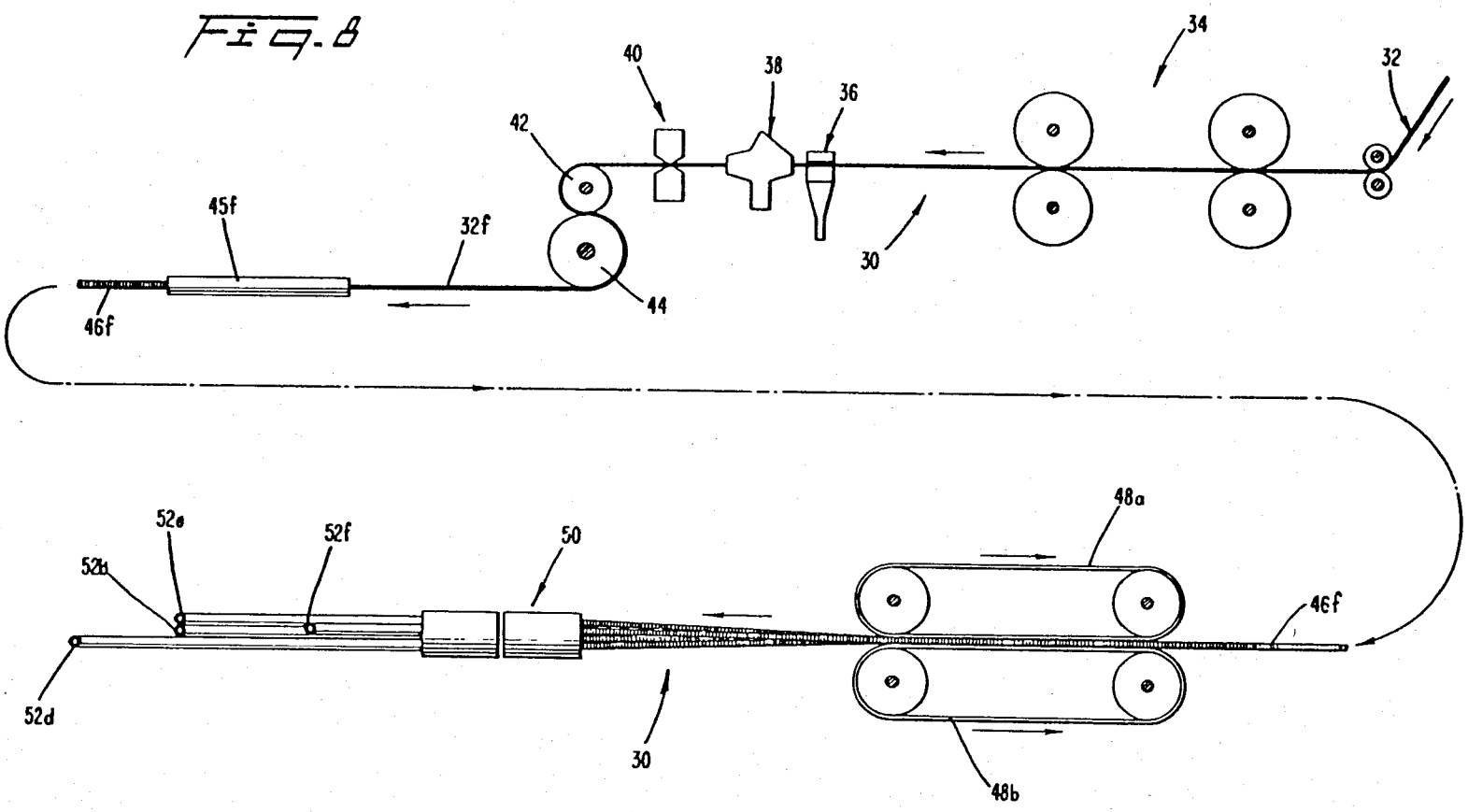
FIG. 8 is a schematic elevational view thereof.

Thus, after passing through the cooling station 84, the tow has now been formed into a self-sustaining, dimensionally stable, filter rod having a predetermined cross-sectional size and shape which may be fed by the pulling means 48 for further processing. Due to the relatively flexibility of the rods thus produced, they can be bent slightly as seen in FIGS. 6 and 8 to enable them to be passed into a single cutter head 50 for subsequent handling.

In accordance with the broadest aspect of the instant inventive concepts, the filter rod may be withdrawn from the rod-forming station at an average linear speed which is substantially equal to that of the incoming tow being fed into the inlet end 62 of the confined zone within the hollow member 60, whereby the fibers in the resultant rod are substantially maintained in their original orientation generally parallel to their direction or travel through the confined zone. Preferably, however, the filter rod is withdrawn at an average linear speed which is less than that of the incoming tow being fed into the inlet end of the confined zone whereby the fibers are reoriented within the confined zone into an adjacent and overlapping relation to one another in generally successive layers extending generally transverse to the direction of travel of the fibers. This reorientation initially occurs prior to contacting of the tow with the heated gas and when the cooling station has a slightly reduced cross-section, the layers are further compacted in the tow-soaking station 82 prior to being contacted and set by the coolant gas. The resultant product in this preferred embodiment can readily be provided with a resistance to flow which is higher in the longitudinal direction than in the transverse direction, thereby enabling, as pointed out above, the relatively high ratio of ventilation air to smoke when the ultimate filter plugs are utilized in an air-diluted cigarette such as shown in FIG. 1.

Regardless of the relative rate of withdrawal of the resultant filter rods, due to the pneumatic feeding technique at least a major portion of the crimp initially present in the fibers is retained by them after processing according to the instant inventive concepts. Moreover, secondary crimp is imparted to the fibers by the preferred processing techniques of the instant invention and retained by the fibers in the resulting fiber rod. The relationship between the average linear speed of the incoming tow being fed into the inlet end 62 of the confined zone within the hollow member 60 to the average linear speed of the filter rod being withdrawn from the processing line will be approximately 1:1 for the production of a rod with the fibers substantially maintained in their original orientation generally parallel to the direction of travel within the confined zone. When it is desired to reorient the fibers into an adjacent and overlapping relation to one another in generally successive layers extending generally transverse to the direction of travel of the fibers, as shown schematically in FIGS. 2 and 3, the ratio of the average linear speed of the incoming tow to the average linear speed of the filter rod being withdrawn is preferably within the range of from about 2:1 to about 4:1.

The withdrawing rate of the filter rods may be readily controlled by selective operation of the pulling means 48 and the average linear speed of the incoming tow being fed into the confined zone may be readily controllably varied responsive to controlled variations in the feeding gas rate of the jet 64.

Although the exact dimensions and materials used may be substantially varied without departing from the instant inventive concepts, the following illustrative information is included for completing the disclosure.

A preferred rod-forming station 45 having a total length of approximately $30\frac{5}{8}$ inches from the point at which the feeding air is introduced at 70 to the point at which the secondary air is introduced at 92 has a steam-soaking section approximately 16 inches long from the point at which the steam is introduced at 78 to the point at which the primary coolant air is introduced at 9C. The length of the steam-soaking section can obviously be varied dependent upon the speed at which the processing line is operated, the important factor being the provision of adequate residence time to enable the steam to penetrate to the very center of the tow within the confined zone therein. For the production of a filter rod having a nominal cross-section diameter of 8 mm, the internal bore of the jet 64 is approximately 0.200 inches in diameter, with the diameter of the confined zone within the hollow member 60 being approximately 0.348 inches and the diameter within the cooling station 84 being approximately 8 mm.

The initial porous portion 74 of the rod-forming station is comprised of six rows of 0.039 inch diameter holes, sixteen per row, preceded by four rows of approximately 1/32 inch diameter, thirty per row. This relatively small porous portion is capable of dissipating a major portion, in fact substantially all of the feed air introduced at the jet 64.

Using a 1.6/25000 No. 10 tow with an input rate of 200 M/M and a take-off rate of 133 M/M, a delivery air flow at the jet of 19 SCFM feeds the tow through the confined zone, this feed air being dissipated substantially entirely at the porous portion 74. Steam is introduced at 45° counter-currently under pressure of 9 psig, the primary and secondary air being introduced co-currently at approximately 45° under pressures of 9 psig, respectively. With the foregoing parameters, the two weight in a 100 mm rod is 0.507 grams, with a 25 mm tip having a pressure drop of 4.0 inches of water and a retention of total particulate matter of approximately 66.2%.

Utilizing the techniques of the instant invention for the production of multiple pneumatically fed filter rods material savings, depending upon the particular tow being utilized, of from 15 to over 45% can be realized as compared to filters produced using conventional techniques. Average weight savings on the order of 30% are seen.

By varying the parameters set forth above, filters may be produced with any desired pressure drop. For example, for 25 mm tips pressure drops ranging from 3.0 to 10.8 inches of water can readily be produced. Such filters have total particulate material retentions for a 25 mm tip of from 58.6 to 85.8%, although variations may be recognized in individual runs. Unexpectedly, however, the relatively low weight products of the instant invention have at least as good and generally better retention than prior art filters of a higher weight produced according to conventional techniques. Further, the products of this invention are self-sustaining, requiring no plug wrap, enabling the production of air-diluted cigarettes in a significantly less expensive manner. The instant inventive concepts, particularly considering the ability to produce multiple fiber rods simultaneously from a slit tow has obvious commercial advantages. Since the product has a smooth peripheral surface, in contrast to the embossed surface resulting from prior non-wrapped production techniques, adhesive bonding to the tipping overwrap is significantly enhanced while the bent nature of the fibers presented at the periphery of the rod avoids fraying problems. All in all, the instant invention enables the use of a minimum of raw material to produce the highest number of filter units for a given labor cost. It is believed that the multiple processing technique of this invention can increase output from 2 to 6 times the current production levels. Moreover, the products are more symmetrical than is available with prior art techniques and by being forced outwardly against the walls of the confined zone within the cooling station are produced with machine shop precision. By producing a filter plug with substantially transversely extending fibers the resistance to air flow is opposite to that with conventional filters, that is, the resistance is greater lengthwise than transversely enabling the use of less material for the production of a filter having a given pressure drop and providing improved and more uniform air dilution, requiring less perforation of the tipping paper for the same level of dilution and possible enabling the reduction of certain gas phase constituents of the smoke.

In addition, the improved feeding jet of the instant invention offers a significant air saving on the order of perhaps 50% when compared to stuffer jet techniques and even more when compared to other prior art jet feeding devices. By eliminating the need for a porous belt, machine efficiency is improved as discussed in some detail hereinabove.

The variability of the product produced is fully selective with any desired pressure drop within reason being obtainable using the same tow, but modifying the relative feed and take-off rates in the device.

Although the largest number of advantages can be realized utilizing the techniques of this invention which reorient the fibers during processing, the basic concepts of this invention produce more conventional rods which still have a weight saving and improved retention even if the feed and take-off rates are substantially identical.

A variety of materials may be utilized according to the instant inventive concept as discussed above, thermoplastic material such as polyethylene, polypropylene and the like being applicable, but the preferred material being cellulose acetate tow. The individual and total denier of the tow may also be varied substantially. A total denier of between 5000 and 40,000 easily being accommodated to the techniques of this invention, with tows of up to 100,000 total denier even being useful as a starting material. As indicated above, it is less expensive to buy a higher total denier tow and slit it according to the instant invention to produce a multiplicity of bands than to initially buy a low total denier material. Since the product of this invention can be produced with a low total denier tow, the multiple processing techniques are particularly advantageous.

It will now be seen that there is herein disclosed an improved method and apparatus for the production of filter rods, particularly for use as tobacco smoke filter elements in air-diluted cigarettes, which satisfy all of the objectives of the instant invention as set forth above, and others, including many advantages of great practical utility and commercial importance.

The embodiments of the invention in which an exclusive property or privilege is claimed are defined as follows:

1. A method for the production of a self-sustaining, dimensionally stable, axially elongated smoke filter rod of predetermined cross-sectional size and shape from a continuous filamentary tow of substantially continuous thermoplastic fibers rendered bondable by the application of heat, comprising the steps of:

(a) continuously feeding said tow into the inlet end of an elongated confined zone having throughout its length a substantially uniform cross-sectional size and shape, said confined zone being non-porous along a first portion of its length extending from said inlet end thereof and being porous along a second portion of its length downstream from said first portion;

(b) simultaneously continously feeding gas under pressure into said inlet end of said confined zone in the same general direction as said tow at an angle of about 0°–20° with respect to the longitudinal axis of said confined zone and at a feed rate sufficiently high so as to pneumatically convey said tow through said confined zone in a rod-like formation substantially conforming to the cross-sectional size and shape of said confined zone and sufficiently low so as to permit escape of at least a major portion of said feeding gas from said confined zone along said porous second portion of its length;

(c) introducing a heated gas into said tow during its passage through said confined zone along a third portion of the length of said confined zone downstream from said porous second portion;

(d) maintaining said tow in contact with said heated gas for a time sufficient to permit said heated gas to contact said tow across substantially its entire cross-section to render said tow bondable;

(e) introducing a coolant gas into said heated tow to bond said tow into a self-sustaining, dimensionally stable, filter rod having said predetermined cross-sectional size and shape; and (f) continuously withdrawing said filter rod.

2. The method of claim 1, further including the step of transversely cutting said filter rod into segments of predetermined length.

3. The method of claim 1, wherein said thermoplastic fibers are plasticized cellulose acetate fibers and said heated gas is steam.

4. The method of claim 1, wherein said heated gas is introduced peripherally into said tow counter-currently with respect to the direction of travel of said tow, and said coolant gas is peripherally introduced into said tow co-currently with respect to the direction of travel of said tow.

5. The method of claim 4, wherein said confined zone includes at least one additional porous portion downstream of the introduction of said heated gas and upstream of the introduction of said coolant gas to permit escape of any remaining portion of said feeding gas and relieve any back pressure from said coolant gas.

6. The method of claim 1, wherein the incoming tow is fed into said inlet end of said confined zone at an average linear speed of at least about 75 meters/min.

7. The method of claim 6, wherein said tow is maintained in contact with said heated gas in a fourth portion of said confined zone downstream of said third portion for at least about 0.1 sec. to permit said heated gas to penetrate the entire cross-section of said tow prior to contacting same with said coolant gas.

8. The method of claim 1, wherein the incoming tow is fed into said inlet end of said confined zone in a rod-like formation having a cross-sectional size smaller than that of said confined zone, and the incoming gas under pressure is fed into said inlet end of said confined zone concentrically around said incoming tow via a venturi throat of annular cross-section, thereby creating at said inlet end of said confined zone a suction effect which serves to draw said incoming tow into said inlet end of said confined zone at a rate proportional to said gas feed rate.

9. The method of claim 8, wherein the rod-like formation of incoming tow being fed into said inlet end of said confined zone is of sufficient density so as to substantially prevent escape of said incoming gas from said confined zone through said incoming tow.

10. The method of claim 9, wherein said rod-like formation of incoming tow being fed into said inlet end of said confined zone has a total denier within the range of from about 5,000 to about 40,000.

11. The method of claim 1, wherein said filter rod is substantially circular in cross-section and has a diameter of aproximately 8 mm.

12. The method of claim 1, wherein the incoming tow being fed into said inlet end of said confined zone is composed of crimped thermoplastic fibers, and at least a major portion of the crimp initially present in said fibers is retained by them in the resulting filter rod.

13. The method of claim 12, wherein secondary crimp is imparted to said fibers by means of said feeding gas under pressure during passage through said confined zone, and at least a major portion of said secondary crimp is retained by said fibers in the resulting filter rod.

14. The method of claim 1, wherein said filter rod is withdrawn at an average linear speed which is substantially equal to that of the incoming tow being fed into said inlet end of said confined zone, whereby said fibers are substantially maintained in their original orientation generally parallel to their direction of travel within said confined zone.

15. The method of claim 1, wherein said filter rod is withdrawn at an average linear speed which is less than that of the incoming tow being fed into said inlet end of said confined zone, whereby said fibers are reoriented within said confined zone into an adjacent and overlapping relation to one another in generally successive layers extending generally transverse to the direction of travel of said fibers, said reorientation initially occurring prior to contacting of said tow with said heated gas.

16. The method of claim 15, wherein the ratio of the average linear speed of the incoming tow being fed into said inlet end of said confined zone to the average linear speed of the filter rod being withdrawn is within the range of from about 2:1 to about 4:1.

17. The method of claim 1, wherein the contacting of said heated tow with said coolant gas is carried out within a further confined zone downstream from said third portion of said first-mentioned confined zone, said further confined zone being of a cross-sectional size and shape equal to said predetermined cross-sectional size and shape of said filter rod and slightly smaller in cross-sectional size than the cross-sectional size of said first-mentioned confined zone.

18. The method of claim 17, wherein said filter rod is withdrawn at an average linear speed which is less than that of the incoming tow being fed into said inlet end of said confined area, whereby said fibers are reoriented within said confined zone into an adjacent and overlapping relation to one another in generally successive layers extending generally transverse to the direction of travel, said reorientation initially occurring prior to contacting of said tow of said fibers with said heated gas, and said layers being further compacted by engaging said slightly smaller cross-sectional size of said further confined zone after being contacted by said heated gas and prior to being contacted with said coolant gas.

19. The method of claim 1, wherein a plurality of said elongated confined zones arranged in substantially parallel relation to each other are employed for simultaneously forming a plurality of said filter rods from a single length of the starting continuous filamentary tow, including the additional step, prior to step (a), of continuously longitudinally slitting said starting tow into a plurality of bands, and in step (a) simultaneously feeding each of said bands into the inlet end of a separate one of said elongated confined zones.

20. The method of claim 19, wherein said bands are all of substantially equal total denier.

21. The method of claim 19, wherein subsequent to step (f), said plurality of filter rods are gathered together into a cluster-like arrangement and then simultaneously transversely cutting said plurality of filter rods into a multiplicity of segments of substantially equal predetermined length.

22. The method of claim 21, wherein during said cutting step said filter rods are maintained in separately confined spaced relation to one another within said cluster-like arrangement, and subsequent to said cutting step, each group of said segments cut from a single one of said filter rods is separately recovered.

23. The method of claim 22, wherein each of said group of segments is pneumatically conveyed through a separate tubular conduit from the cutting station to the recovery station.

24. An apparatus for the production of a self-sustaining, dimensionally stable, axially elongated smoke filter rod of predetermined cross-sectional size and shape from a continuous filamentary tow of substantially continuous thermoplastic fibers comprising, in combination:

(a) an elongated hollow member defining an elongated confined zone having an inlet end and an outlet end, said confined zone having throughout its length a substantially uniform cross-sectional size and shape, said hollow member being non-porous along a first portion of its length extending from said inlet end and being porous along a second portion of its length downstream from said first portion so as to provide communication between said confined zone and the surrounding air along said second portion;

(b) means for feeding said tow into said inlet end of said confined zone;

(c) means for feeding gas under pressure into said inlet end of said confined zone in the same general direction as said tow at an angle of about 0°–20° with respect to the longitudinal axis of said confined zone and at a feed ratio sufficiently high so as to pneumatically convey said tow through said confined zone in a rod-like formation substantially conforming to the cross-sectional size and shape of said confined zone and sufficiently low so as to permit escape of at least a major portion of said gas from said confined zone along said porous second portion of the length of said hollow member;

(d) means for introducing a heated gas into said tow during its passage through said confined zone along a third portion of the length of said hollow member downstream from said porous second section;

(e) tow soaking means for maintaining said tow in contact with said heated gas for a time sufficient to permit said heated gas to contact said tow across substantially its entire cross-section to render said tow bondable;

(f) means for introducing a coolant gas into said heated tow to bond said tow into a self-sustaining, dimensionally stable, filter rod having said predetermined cross-sectional size and shape; and (g) means for withdrawing said filter rod.

25. The apparatus of claim 24, further including cutting means for transversely cutting said filter rod into segments of predetermined length.

26. The apparatus of claim 24, wherein said tow feeding means comprises an elongated tubular member having a bore whose cross-sectional size and shape is smaller than that of said confined zone, said bore having an outlet end leading into said inlet end of said confined zone, and said gas feeding means comprises an annular passageway disposed concentrically around said tubular member and terminating at its outlet end in a venturi throat leading into said inlet end of said confined zone at said angle of about 0°–20° with respect to the longitudinal axis of said confined zone.

27. The apparatus of claim 26, wherein said angle is about 10° with respect to the longitudinal axis of said confined zone.

28. The apparatus of claims 24, wherein said means for introducing a coolant gas into said heated tow defines a further confined zone downstream from said third portion of said first-mentioned confined zone, said further confined zone being of a cross-sectional size and shape equal to said predetermined cross-sectional size and shape of said filter rod and slightly smaller in cross-sectional size than the cross-sectional size of said first-mentioned confined zone.

29. The apparatus of claim 24, wherein said filter rod is circular in cross-section having a diameter of approximately 8 mm.

30. The apparatus of claim 24, wherein said means for introducing heated gas peripherally feeds said heated gas countercurrently with respect to the direction of travel of said tow, and said means for introducing coolant gas feeds said coolant gas cocurrently with respect to the direction of travel of said tow.

31. The apparatus of claim 30, further including at least one additional porous portion in said confined zone between said means for introducing a heated gas into said tow and said means for introducing a coolant gas into said tow to permit escape of any remaining portion of said feeding gas and relieve any back pressure from said coolant gas.

32. The apparatus of claim 24, wherein the ratio of the average linear speed of the incoming tow being fed into said inlet end of said confined zone to the average linear speed of the filter rod being withdrawn is controllably variable over the range of from about 1:1 to about 4:1.

33. The apparatus of claim 32, wherein the average linear speed of the incoming tow being fed into said inlet end of said confined zone is controllably variable responsive to controlled variations in said gas feed rate.

34. An apparatus in accordance with claim 24, wherein a plurality of said elongated hollow members are arranged in substantially parallel relation to each other, each of said hollow members having associated therewith the tow feeding means, the gas feeding means, and the filter rod withdrawing means, all as defined in claim 24, and further including tow slitting means disposed upstream from said plurality of hollow members for longitudinally slitting the starting continuous filamentary tow into a plurality of bands corresponding in number to said plurality of hollow members, whereby a plurality of said filter rods may be simultaneously formed from a single length of said starting tow.

35. The apparatus of claim 34, further including cutting means for transversely cutting each of said filter rods into segments of predetermined length.

36. The apparatus of claim 5, further including means for passing said plurality of filter rods through said cutting means in a cluster-like arrangement for unitary cutting.

37. The apparatus of claim 36, wherein said filter rod passing means contains separate spaced passageways for each of said filter rods, and the outlet end of each of said passageways leads into separate conduit means for separate recovery of each group of said segments cut from a single one of said filter rods.

* * * * *